US008807513B2

(12) United States Patent
Volin

(10) Patent No.: US 8,807,513 B2
(45) Date of Patent: Aug. 19, 2014

(54) UNIQUE MULTI-ADJUSTABLE ROTATING-AND-LOCKING UMBRELLA-STANCHION SYSTEM

(76) Inventor: Dee Volin, Fairview, OR (US)

( * ) Notice: Subject to any disclaimer, the term of this patent is extended or adjusted under 35 U.S.C. 154(b) by 224 days.

(21) Appl. No.: 13/594,127

(22) Filed: Aug. 24, 2012

(65) Prior Publication Data

US 2013/0306828 A1 Nov. 21, 2013

Related U.S. Application Data

(60) Provisional application No. 61/688,783, filed on May 21, 2012.

(51) Int. Cl.
*F16M 13/00* (2006.01)
*A45B 17/00* (2006.01)

(52) U.S. Cl.
CPC ..... *A45B 17/00* (2013.01); *A45B 2017/005* (2013.01)
USPC ..... 248/521; 248/519; 135/16

(58) Field of Classification Search
CPC ..... A45B 17/00; A45B 2017/005; E04H 12/2253; E04H 12/2284
USPC ..... 248/519, 521, 522, 523, 528, 529, 127, 248/150, 345, 346.06, 349.1; 135/16, 20.3, 135/152, 908
See application file for complete search history.

(56) References Cited

U.S. PATENT DOCUMENTS 4,582,287 A 4/1986 Deleary
5,060,907 A 10/1991 Castano
5,207,406 A 5/1993 Stine
5,354,031 A 10/1994 Bilotti
6,082,157 A 7/2000 Boyce
6,113,054 A 9/2000 Ma
6,371,432 B1 4/2002 Tsappi
6,405,989 B2 6/2002 Davis
6,405,990 B2 6/2002 Davis
6,412,746 B2 7/2002 Davis
6,412,747 B2 7/2002 Davis
6,435,468 B1 8/2002 Simchoni
6,446,649 B1 9/2002 Bigford
6,446,930 B1 9/2002 Li
6,488,254 B2 * 12/2002 Li ..... 248/521
6,511,033 B2 1/2003 Li
6,540,194 B2 4/2003 Schmitt
6,554,243 B2 4/2003 Davis
6,612,534 B2 9/2003 Hennessey
6,637,717 B2 10/2003 Li
6,827,321 B1 12/2004 Murren
6,869,058 B2 3/2005 Tung (Continued)

*Primary Examiner* — Tan Le

(57) ABSTRACT

A multi-adjustable, rotating, and opposite-double-locking umbrella-stanchion system is operated with one finger for oppositely double-locking and -unlocking the umbrella-supporting post of a crank-arm-operated umbrella to secure it in different positions. The system comprises a canopy system, a supporting post, a stanchion base, a U-shaped rotational lever, an actuator arm, a push rod, two opposite L-shaped locking arms, two opposite locking cleats, radial teeth, and two opposite tension springs for pushing the opposite locking cleats downward to oppositely double-lock the post and the canopy system, in place. The radial teeth are molded to the stanchion base. To operate the system, lift the U-shaped rotational lever with one finger to lift the opposite locking cleats to oppositely double-unlock them. Next, rotate the supporting post to a desired position. Then, release the U-shaped rotational lever to oppositely double-lock the opposite locking cleats between the radial teeth.

20 Claims, 17 Drawing Sheets

(56) References Cited

U.S. PATENT DOCUMENTS

| | | | | |
|---|---|---|---|---|
| 6,877,708 | B1 | 4/2005 | Thurner | |
| 6,889,953 | B2 | 5/2005 | Harbaugh | |
| 6,895,982 | B1 | 5/2005 | Shaw | |
| 6,986,496 | B2 | 1/2006 | Woude | |
| 7,021,598 | B2 | 4/2006 | Kao | |
| 7,246,783 | B2 | 7/2007 | Harold | |
| 7,431,259 | B2 * | 10/2008 | Tung | 248/521 |
| 7,503,541 | B2 | 3/2009 | Harold | |
| 7,513,479 | B2 | 4/2009 | Li | |
| 7,614,600 | B1 | 11/2009 | Smith | |
| 7,641,165 | B2 | 1/2010 | Li | |
| 7,780,139 | B2 | 8/2010 | Markert | |
| 7,784,761 | B2 | 8/2010 | Ma | |
| 7,836,902 | B2 * | 11/2010 | Tung | 135/20.3 |
| 7,886,755 | B2 * | 2/2011 | Tung | 135/21 |
| 7,891,633 | B2 | 2/2011 | Li | |
| 7,926,496 | B2 | 4/2011 | Young | |
| 2002/0053631 | A1 * | 5/2002 | Li | 248/521 |
| 2002/0185582 | A1 * | 12/2002 | Li | 248/522 |
| 2012/0024329 | A1 * | 2/2012 | Ma | 135/16 |

* cited by examiner

UNIQUE MULTI-ADJUSTABLE ROTATING-AND-LOCKING UMBRELLA-STANCHION SYSTEM

REFERENCE TO PREVIOUSLY FILED PROVISIONAL PATENT APPLICATION

Provisional Patent Application No. 61/688,783 was filed on May 21, 2012.

FIELD OF THE INVENTION

The present invention relates to a unique multi-adjustable, rotating, and opposite-double-locking umbrella-stanchion system having opposite L-shaped locking arms, which can be operated with one finger for oppositely double-locking and oppositely double-unlocking the umbrella-supporting post of a crank-arm-operated collapsible-canopy umbrella system after the umbrella supporting post is rotated to a desired position.

DESCRIPTION OF THE PRIOR ART

A number of inventions of collapsible-top umbrella have been introduced. U.S. Pat. No. 4,582,287, filed Feb. 3, 1984, to Deleary, Robert H.; U.S. Pat. No. 5,060,907, filed Jan. 12, 1990, to Castano, Francisco; U.S. Pat. No. 5,207,406, filed Mar. 9, 1992, to Stine, Janice M.; U.S. Pat. No. 5,354,031, filed Mar. 29, 1993, to Bilotti, Alfred J.; U.S. Pat. No. 6,082, 157 filed Mar. 19, 1999 to Boyce, Stuart T.; U.S. Pat. No. 6,113,054, filed Feb. 12, 1999, to Joen-An Ma, Oliver; U.S. Pat. No. 6,371,432, filed Nov. 15, 1996, to Tsappi, Philip; U.S. Pat. No. 6,405,989, filed Mar. 22, 2001, to Davis, Mark E.; U.S. Pat. No. 6,405,990, filed Mar. 22, 2001, to Davis, Mark E.; U.S. Pat. No. 6,412,746, filed Mar. 22, 2001, to Davis, Mark E.; U.S. Pat. No. 6,412,747, filed Mar. 22, 2001, to Davis, Mark E.; U.S. Pat. No. 6,435,468, filed Oct. 26, 2000, to Simchoni, Dror; U.S. Pat. No. 6,446,649, filed Sep. 13, 2000, to Bigford, Barbara; U.S. Pat. No. 6,446,930, filed Oct. 14, 1999, to Li, Jun; U.S. Pat. No. 6,511,033, filed May 10, 2001, to Ying Li, Wanda; U.S. Pat. No. 6,540,194, filed Apr. 18, 2001, to Schmitt, Rolf Peter; U.S. Pat. No. 6,554, 243, filed Mar. 22, 2001, to Davis, Mark E.; U.S. Pat. No. 6,612,534, filed Aug. 20, 2001, to Hennessey, James R.; U.S. Pat. No. 6,637,717, filed Jul. 29, 2002, to Ying Li, Wanda; U.S. Pat. No. 6,827,321, filed May 12, 2003, to Munen, Andrew J.; U.S. Pat. No. 6,869,058, filed Jun. 17, 2003, Tung, Benson; U.S. Pat. No. 6,877,708, filed. Jan. 23, 2003, to Thurner, Guenther; U.S. Pat. No. 6,889,953, filed Sep. 19, 2002, to Harbaugh, Kenneth A.; U.S. Pat. No. 6,895,982, filed Dec. 23, 2002, to Shaw, Michael Alan; U.S. Pat. No. 6,986, 496, filed Jul. 31, 2003, to Woude, Keith Vander; U.S. Pat. No. 7,021,598, filed Feb. 24, 2003, to Kao, Cheung chong; U.S. Pat. No. 7,246,783, filed Dec. 8, 2005, to Harold, Robert; U.S. Pat. No. 7,503,541, filed Jun. 22, 2007, to Harold, Robert; U.S. Pat. No. 7,513,479, filed May 29, 2007, to Ying Li, Wanda; U.S. Pat. No. 7,614,600, filed Dec. 22, 2004, to Smith, James C.; U.S. Pat. No. 7,641,165, filed Feb. 12, 2008, to Ying Li, Wanda; U.S. Pat. No. 7,780,139, filed Sep. 30, 2005, to Markert, Tom; U.S. Pat. No. 7,784,761, filed Feb. 17, 2006, to Joen-an Ma, Oliver; U.S. Pat. No. 7,891,633, filed Nov. 16, 2009, to Ying Li, Wanda; and U.S. Pat. No. 7,926, 496, filed Jun. 1, 2009, to Young, David disclose a variety of umbrella stands. All the prior-art inventions have failed to solve many inherent problems associated with such umbrella stands, as follows:

1) To unlock an umbrella post, rotate it to a desired position, and lock it in place, a user has to use both his hand and his foot, simultaneously.

2) While unlocking an umbrella post, rotating it to a desired position, and locking it in place, a user must stand on only one foot.

3) In order to work with the prior-art umbrella stand, the umbrella post must have a specific diameter. This require a specific umbrella post for a specific umbrella stand. As a result of this, their production cost will be higher and they require larger space in ware house.

4) In order to work with the prior-art umbrella stand, the umbrella post must have a specific diameter. This require a specific umbrella post for a specific umbrella stand. This increases inconvenience for end users.

5) The umbrella-post-locking systems of the prior art do not oppositely double-lock the umbrella post. They only single-lock the umbrella post. As a result of this, over an extended period of use, the umbrella-post-locking systems of the prior art will bend out of shape, making it harder to operate and decreasing their reliability.

6) To operate the umbrella-post-locking systems, a user must stand on one of his feet, and use the other foot and one of his hands, simultaneously. As a result of this, the umbrella-post-locking systems of the prior art are cumbersome to operate.

7) To operate the stand, a user must stand on one of his feet, and has to:

a) Push down and hold the footstep (with his other foot) to unlock the umbrella post.
b) Rotate the umbrella post (with his hand) to a desired position,
c) Release the footstep to lift it up,
d) Wiggle the footstep and the umbrella post back and forth until the locking gear of the footstep locks between the teeth of the rotor of the umbrella, post and, thus, locks the umbrella post in place.

8) The outward-protruding foot lever of the prior-art umbrella stand poses highly hazardous risk for serious personal injuries.

OBJECTS AND ADVANTAGES OF THE INVENTION

The unique multi-adjustable, rotating, and opposite-double-locking umbrella-stanchion system overcomes all the disadvantages of the prior art heretofore. The unique multi-adjustable, rotating, and opposite-double-locking umbrella-stanchion system substantially departs from the conventional concepts and designs of the prior art. In doing so, the unique multi-adjustable, rotating, and opposite-double-locking umbrella-stanchion system provides many unique, significant advantages, some of which are, as follows:

1) It is an object of the present invention to provide a unique multi-adjustable, rotating, and opposite-double-locking umbrella-stanchion system, which can be operated with one finger. As a result, this invention eliminates the prior-art problem of requiring a user to use both hand and foot, simultaneously, to operate.

2) It is another object of the present invention to provide, a unique multi-adjustable, rotating, and opposite-double-locking umbrella-stanchion system, which allows a user to keep both feet firmly on the ground while operating the system, especially when the ground is snowy or wet. As a result, this invention eliminates personal injuries, caused by the prior art.

3) It is another object of the present invention to provide a unique multi-adjustable, rotating, and opposite-double-locking umbrella-stanchion system, which eliminates a foot pedal protruding outward from the base of an umbrella, as needed in the prior art to operate its umbrella system. A foot pedal protruding from an umbrella base is very hazardous, for example, when there are a gathering with a lot of people and young children playing and running around. They can trip on the protruding foot pedal and fall. As a result, this invention eliminates personal injuries, caused by the prior art.

4) It is another object of the present invention to provide a unique multi-adjustable, rotating, and opposite-double-locking umbrella-stanchion system, which allows a user to keep both feet firmly on the ground while operating the system. As a result, this invention allows a user to rotate the system a substantially larger angle than the prior an can.

5) It is another object of the present invention to provide a unique multi-adjustable, rotating, and opposite-double-locking umbrella-stanchion system, which oppositely double-locks the umbrella post. As a result of this, the unique multi-adjustable, rotating, and opposite-double-locking umbrella-stanchion system will not bend out of shape, over an extended period of use. This increases its reliability.

6) It is another object of the present invention to provide a unique multi-adjustable, rotating, and opposite-double-locking umbrella-stanchion system, which can be operated with one finger. As a result, this eliminates the needs for using both hand and foot, simultaneously, to operate the system, a user must stand on one of his feet, and use the other foot and one of his hands, simultaneously. Therefore, the unique multi adjustable, rotating, and opposite-double-locking umbrella-stanchion system is simple to operate.

7) It is another object of the present invention to provide a unique multi-adjustable, rotating, and opposite-double-locking umbrella-stanchion system, which can be operated with one of his fingers, as follows:

a) A user simply lifts a lever on the umbrella post (with one of his fingers), and b) Simply rotates the umbrella post to a desired position, and releases the lever.

8) It is another object of the present invention to provide a unique multi-adjustable, rotating, and opposite-double-locking umbrella-stanchion system, which eliminates all hazardous levers, poking outward from the umbrella stand, keeping the umbrella stand smooth and stylish, and providing safety to user.

As a result, the unique multi-adjustable, rotating, and opposite-double-locking umbrella-stanchion system overcomes all the disadvantages of the prior art. These above and additional advantages are described and illustrated in the following examples and illustrations.

SUMMARY OF THE INVENTION

Figure 1:
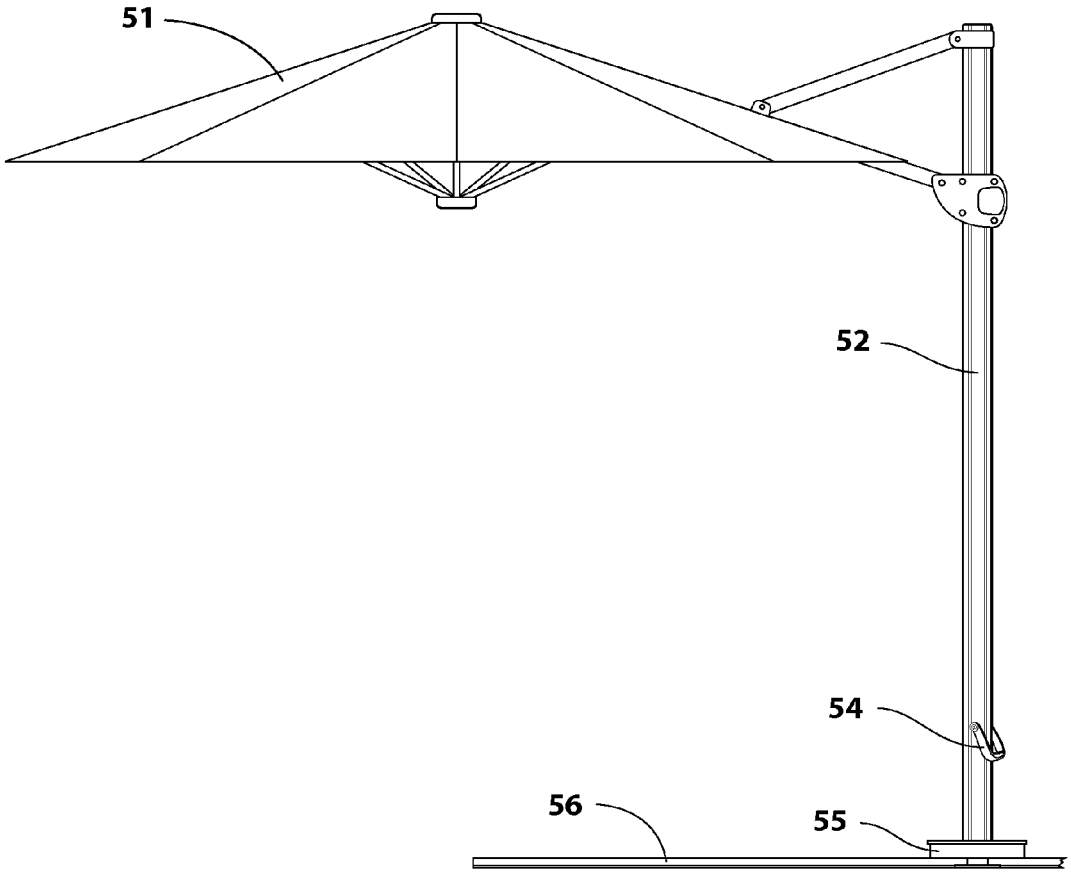
FIG. 1 illustrates a side view of a unique multi-adjustable, rotating, and opposite-double-locking umbrella-stanchion system.
Figure 2:
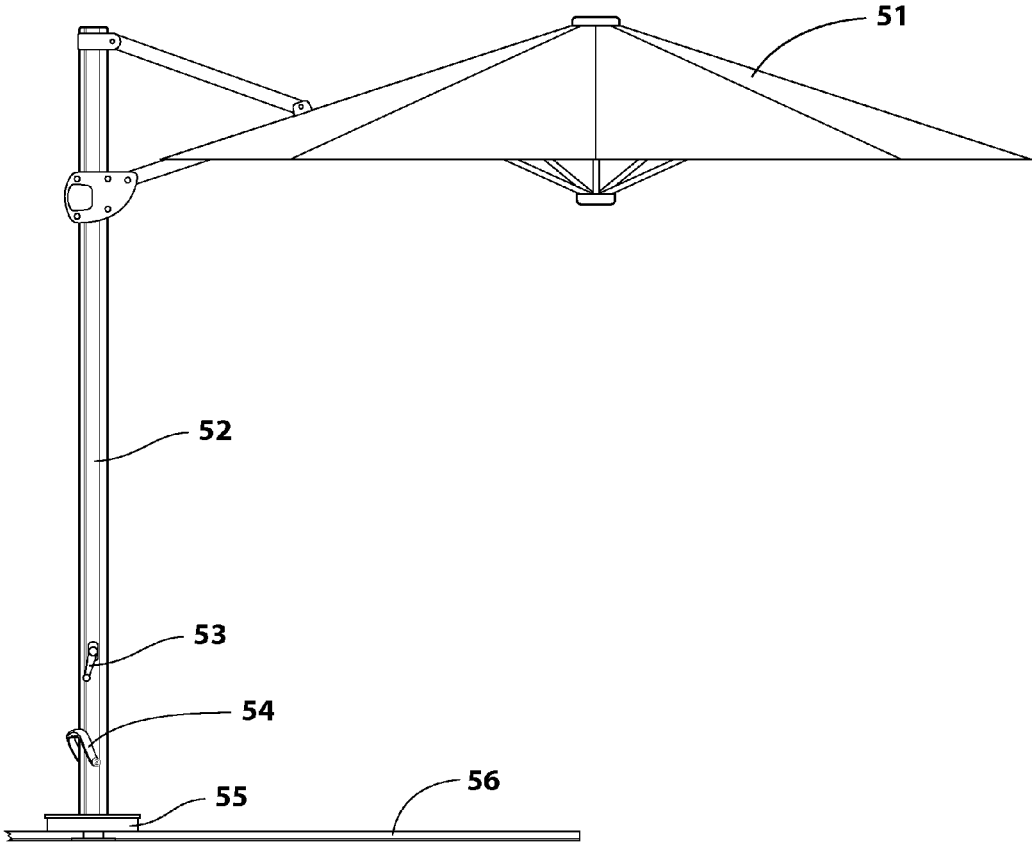
FIG. 2 illustrates a side view of the unique multi-adjustable, rotating, and opposite-double-locking umbrella-stanchion system after being rotated to a new position.

A unique multi-adjustable, rotating, and opposite-double-locking umbrella-stanchion system, which can be operated with one finger for oppositely double-locking and oppositely double-unlocking the umbrella-supporting post of a crank-arm-operated collapsible-top umbrella to secure it in different desired positions. The unique multi-adjustable, rotating, and opposite-double-locking umbrella-stanchion system comprises a collapsible umbrella-canopy system, an umbrella-supporting post, a stanchion base, a U-shaped rotational lever, an actuator arm, a push rod, two opposite L-shaped locking arms, two opposite locking cleats, radial teeth, and two opposite tension springs for pushing the two opposite locking cleats downward between the radial teeth, to oppositely double-lock the umbrella-supporting post and the collapsible umbrella-canopy system, in place. The umbrella-supporting post is connected to the collapsible umbrella-canopy system. The stanchion base is connected to the umbrella-supporting post. The U-shaped rotational lever is connected to the umbrella-supporting post. Inside umbrella-supporting post and the stanchion base, the U-shaped rotational lever, the actuator arm, the push rod, the two opposite L-shaped locking, arms, and the two opposite locking cleats are connected consecutively in the above-mentioned order. The radial teeth are molded to the stanchion base. To operate the unique system, lift the rotational lever with one finger to lift the locking cleats over the radial teeth to oppositely double-unlock the supporting post. Next, rotate the supporting post to a desired position. Then, release the rotational lever such that the tension springs push the locking cleats downward back between the radial teeth to oppositely double-lock the supporting post.

PREFERRED EMBODIMENT

Structure

Referring to FIGS. 1, 2, 3A, and 3B, a unique multi-adjustable, rotating, and opposite-double-locking umbrella-stanchion system comprises a collapsible umbrella-canopy system 51 an umbrella-supporting post 52, an umbrella-collapsing crank arm 53, a U-shaped rotational lever 54, a stanchion base 55, a stabilizing foot 56, a square-shaped rotational-lever pin 57, two opposite rotational-lever-pin washers 58, two opposite rotational-lever-pin screws 59, two opposite buttress plates 60, a plurality of opposite buttress-plate rivet openings 61, an actuator arm 62, an actuator-arm retaining post 63, a push rod 64, a circular push-rod foot 65, a push-rod-foot retaining post 66, a plurality of retaining-post clips 67, a push-rod housing shaft 68, a plurality of push-rod-housing-shaft washers 69, a plurality of push-rod-housing-shaft bolts 70, a stanchion-base cover plate 71, two opposite L-shaped locking arms 72*a* and 72*b*, two opposite locking-arm retaining posts 73*a* and 73*b*, two opposite tension springs 74*a* and 74*b*, a plurality of ball bearings 75, a base bearing 76, and a snap ring 77.

Umbrella-supporting post 52 has two opposite rotational-lever-pin openings 78*a* and 78*b*.

U-shaped rotational lever 54 has two opposite square-shaped openings 79*a* and 79*b*.

Stanchion base 55 has a central, circular base opening 79*c*.

Square-shaped rotational-lever pin 57 has two opposite threaded recess 80 at its opposite ends.

Actuator arm 62 has a U-shaped arm 81, a square-shaped passage 82, and two opposite retaining-post openings 83*a* and 83*b*.

Push rod 64 has two opposite retaining-post opening 84*a* and 84*b*.

Push-rod foot 65 has two opposite retaining-post openings 85*a* and 85*b*.

Push-rod housing shaft 68 has two opposite U-shaped rotational-lever-pin slots 86*a* and 86*b*, a plurality of opposite rivets 87, a plurality of opposite rivet openings 88, a base plate 89, and a plurality of bolt openings 90.

Stanchion-base cover plate 71 has a push-rod passage 91, a plurality of bolt openings 92, a stanchion-base cover-plate hub 93, two opposite L-shaped-locking-arm passages 94 and 95, two opposite locking-arm brackets 96*a* and 96*b*, and a snap-ring-retaining channel 97.

Two opposite L-shaped locking arms 72*a* and 72*b* have two opposite locking cleats 98*a* and 98*b*, respectively, two opposite locking-arm-retaining-post openings 99*a* and 99*b*, and two opposite tension-spring slots 99*c* and 99*d*, respectively.

Further, the unique multi-adjustable, rotating, and opposite-double-locking umbrella-stanchion system comprises a bearing groove 100, a plurality of radial teeth 101, an umbrella-stanchion-system-covering top 102, a plurality of covering-top openings 103*a*, a central covering-top opening 103*b*, an umbrella-stanchion-system-covering bottom 104, a plurality of covering-bottom openings 105, a plurality of covering-bottom washers 106, a plurality of covering-bottom screws 107, a plurality of stabilizing-foot openings 108, and a plurality of stabilizing-foot screws 109.

Connection

Figure 3A:
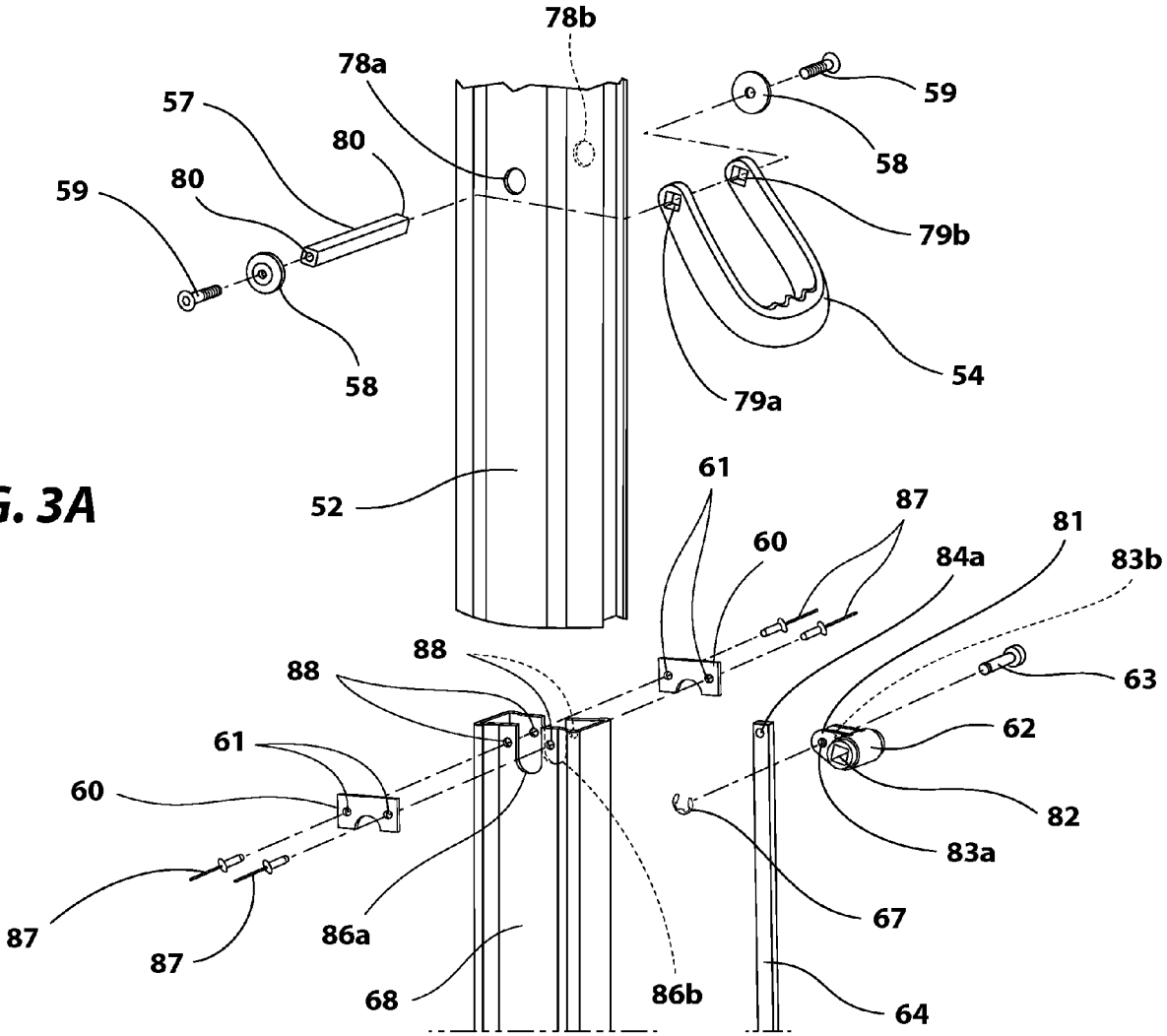
FIGS. 3A and 3B illustrate an exploded view of the unique multi-adjustable, rotating, and opposite-double-locking umbrella-stanchion system.
Figure 3B:
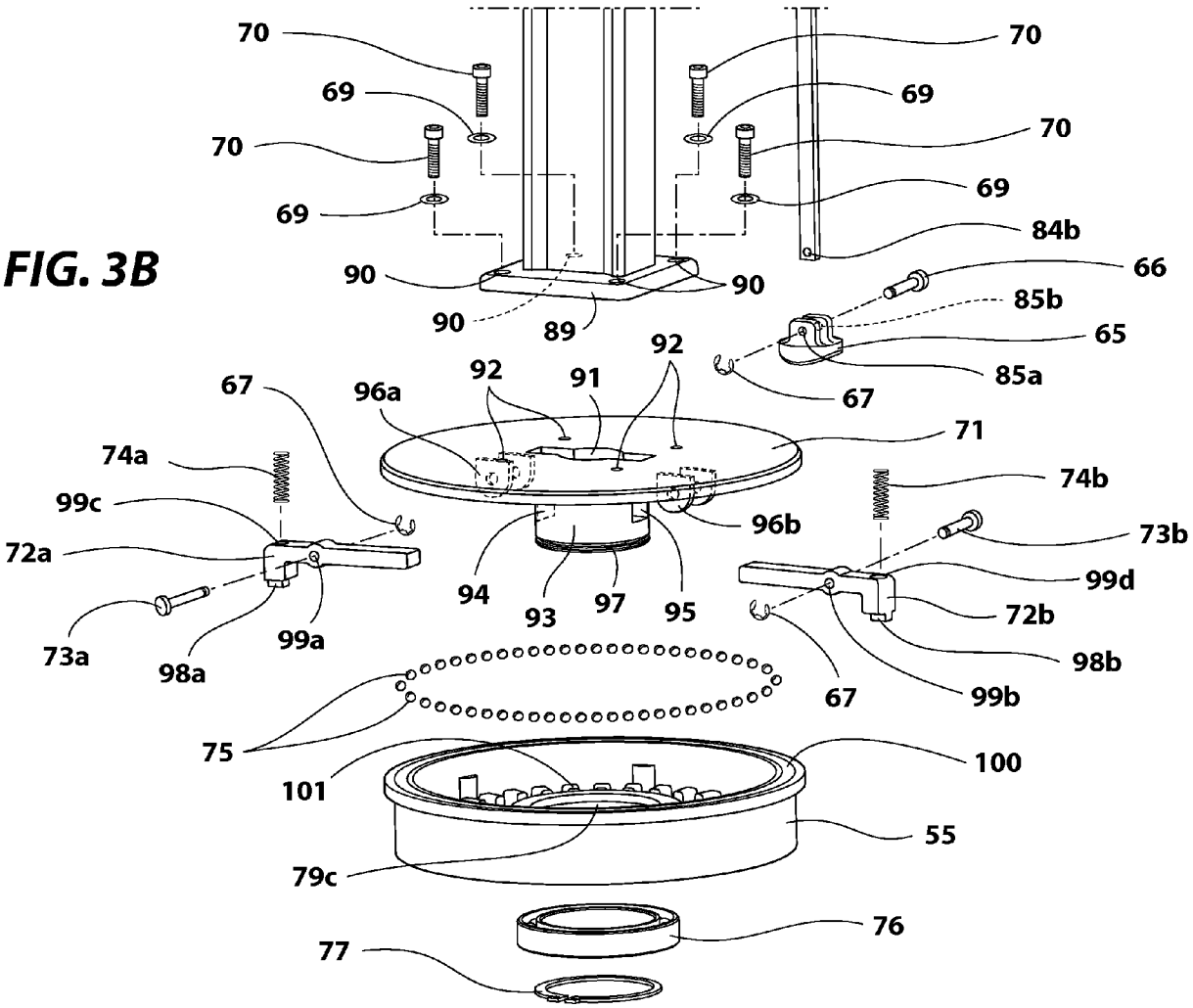
Figure 3C:
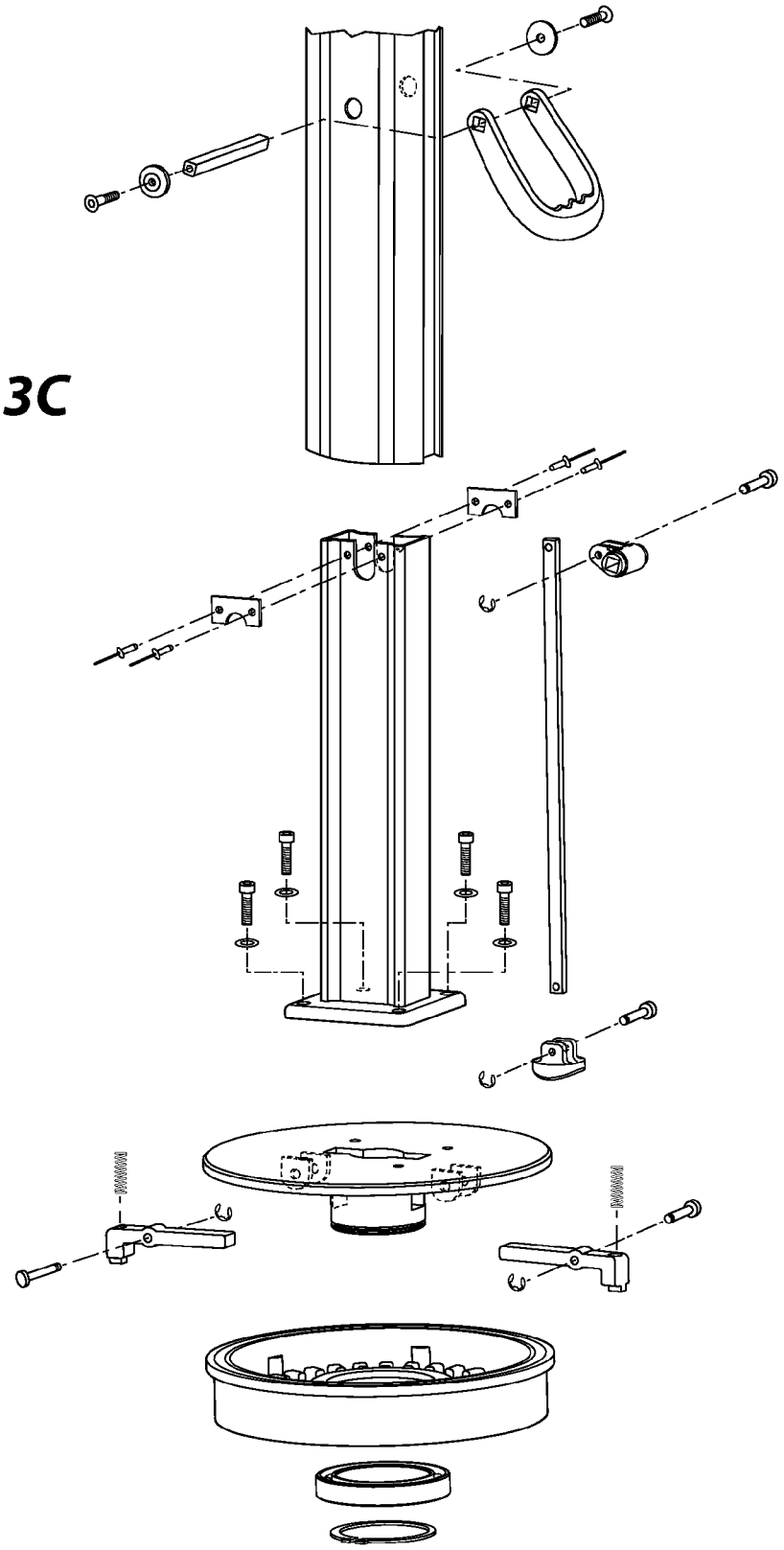
FIG. 3C illustrates an exploded view of how the components of the unique multi-adjustable, rotating, and opposite-double-locking umbrella-stanchion system are connected to one another.
Figure 4A:
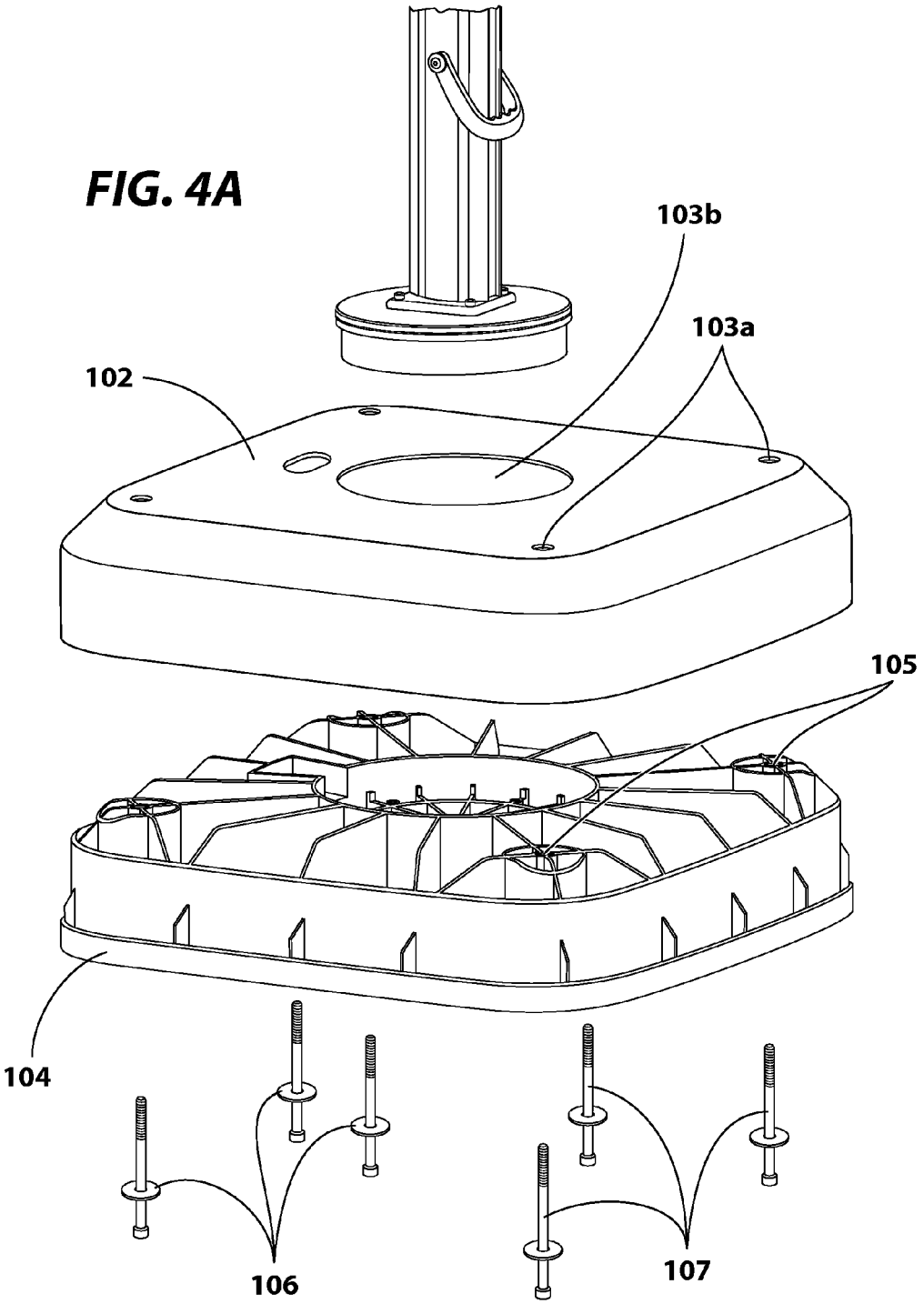
FIG. 4A illustrates a perspective view of how the system-covering top and the system-covering bottom of the unique multi-adjustable, rotating, and opposite-double-locking umbrella-stanchion system are connected to each other.
Figure 4B:
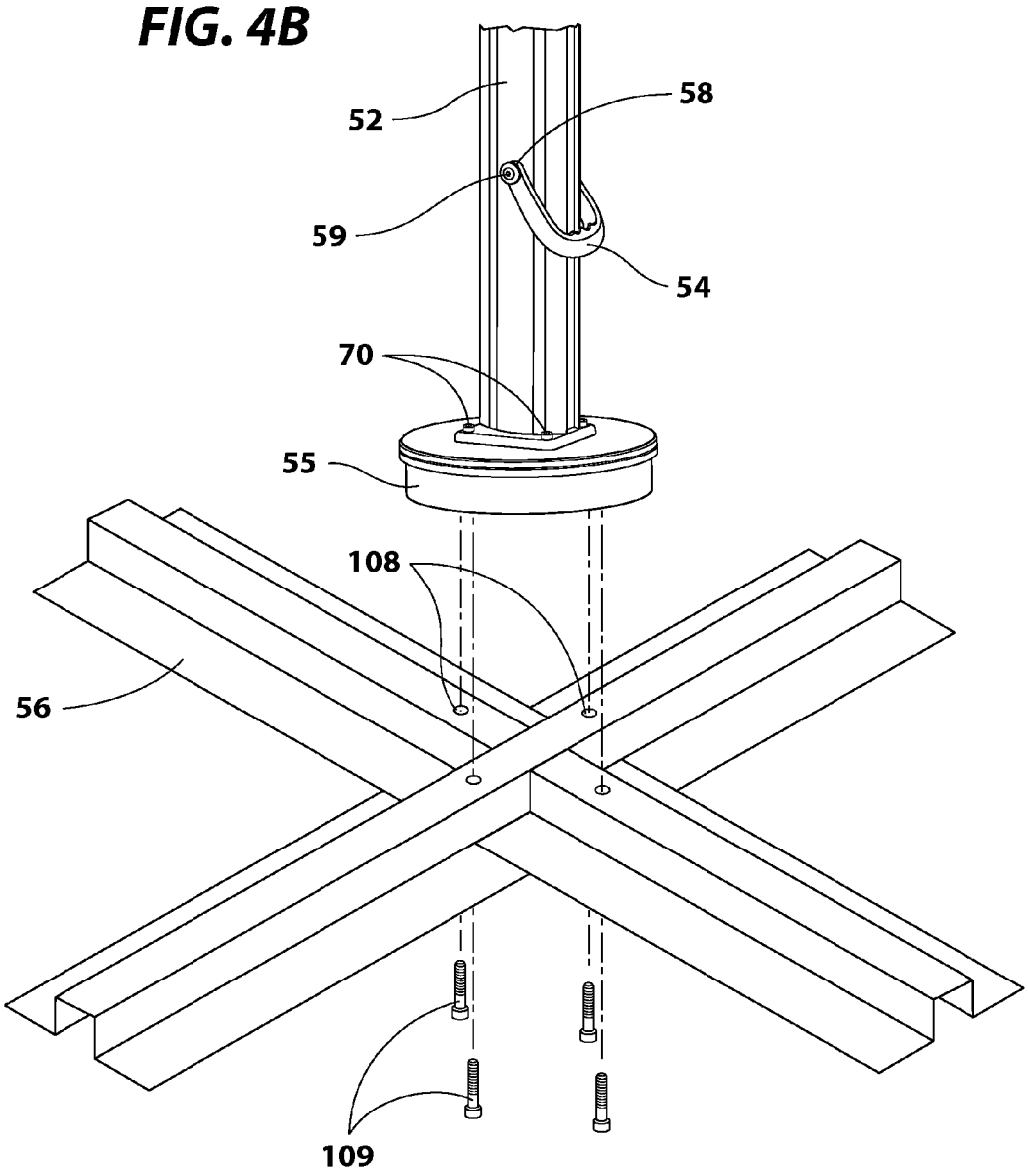
FIG. 4B illustrates a perspective view of how the stanchion base and the stabilizing foot of the unique multi-adjustable, rotating, and opposite-double-locking umbrella-stanchion system are connected to each other.

Referring to FIGS. 3C, 4A, and 4B. The components of the unique multi-adjustable, rotating, and opposite-double-locking umbrella-stanch ion system are connected to one another, as follows:

Square-shaped rotational-lever pin 57 is inserted through opposite rotational-lever-pin openings 78*a* and 78*b*, square-shaped openings 79*a* and 79*b*, and square-shaped passage 82.

Rotational-lever-pin screws 59 are screwed through rotational-lever-pin washers 58, and are screwed into opposite threaded openings 80, respectively, to secure U-shaped rotational lever 54.

Opposite buttress-plate rivet openings 61 are integrated into two opposite buttress plates 60, respectively.

Two opposite rotational-lever-pin openings 78*a* and 78*b* are integrated into the two opposite sides of umbrella-supporting post 52, respectively.

Two opposite square-shaped openings 79*a* and 79*b* are integrated into the two opposite ends of U-shaped rotational lever 54, respectively.

Square-shaped passage 82 is integrated into actuator arm 62 along its longitudinal axis. Two opposite retaining-post openings 83*a* and 83*b* are integrated into the two opposite ends of U-shaped arm 81, respectively.

Two opposite retaining-post opening 84*a* and 84*b* are integrated into the two opposite ends of push rod 64, respectively.

Two opposite retaining-post openings 85*a* and 85*b* are integrated into the two opposite ends of push-rod foot 65, respectively.

Two opposite U-shaped rotational-lever-pin slots 86*a* and 86*b* are integrated into the top end of push-rod housing shaft 68.

Opposite rivet openings 88 are integrated into the two opposite sides of the top end of push-rod housing shaft 68, respectively.

Buttress plates 60 are riveted to the two opposite sides of the top end of push-rod housing shaft 68 using rivets 87, respectively. Base plate 89 is integrated into the bottom end of push-rod housing shaft 68. Bolt openings 90 are integrated into the edge of base plate 89.

Push-rod passage 91 is integrated into the central portion of stanchion-base cover plate 71. Bolt openings 92 are integrated into stanchion-base cover plate 71 around push-rod passage 91. Stanchion-base cover-plate huh 93 is integrated into the bottom of stanchion-base cover plate 71. Two opposite L-shaped-locking-arm passages 94 and 95 are integrated into the opposite sides of Stanchion-base cover-plate hub 93, respectively. Two opposite locking-arm brackets 96*a* and 96*b* are integrated into the bottom of stanchion-base cover plate 71 on the opposite sides of stanchion-base cover-plate hub 93. Snap-ring-retaining channel 97 is integrated into the bottom edge of stanchion-base cover-plate hub 93.

Base plate 89 is screwed on stanchion-base cover plate 71 using push-rod-housing-shaft washers 69 and push-rod-housing-shaft bolts 70.

Two opposite locking cleats 98*a* and 98*b* are integrated into the heads of two opposite L-shaped locking arms 72*a* and 72*b*, respectively. Two opposite locking-arm-retaining-post openings 99*a* and 99*b* are integrated into the bodies of two opposite L-shaped locking arms 72*a* and 72*b*, respectively. Two opposite tension-spring slots 99*c* and 99*d* are integrated into the necks of two opposite L-shaped locking arms 72*a* and 72*b*, respectively. Two opposite tension springs 74*a* and 74*b* are inserted into two opposite tension-spring slots 99*c* and 99*d*, respectively. The tails of two opposite L-shaped locking arms 72*a* and 72*b* are inserted into two opposite L-shaped-locking-arm passages 94 and 95. Two opposite L-shaped locking arms 72*a* and 72*b* are secured to two opposite locking-arm brackets 96*a* and 96*b* using retaining-post clips 67 and locking-arm retaining posts 73*a* and 73*b*, respectively.

Push rod 64 is secured to actuator arm 62 using retaining-post clips 67 and actuator-arm retaining post 63

Push rod 64 is secured to push-rod foot 65 using retaining-post clips 67 and actuator-arm retaining post 66. Push rod 64 is inserted into push-rod housing shaft 68, such that actuator arm 62 rests in square-shaped-rotational-lever-pin slots 86*a* and 86*b* and push-rod toot 65 rests on the tails of opposite L-shaped locking arms 72*a* and 72*b*, respectively.

Bearing groove 100 is integrated into the top edge of stanchion base 55. Radial teeth 101 are integrated into the bottom edge inside stanchion base 55. Ball bearings 75 are inserted into bearing groove 100. Stanchion-base cover plate 71 is seated on ball bearings 75.

Stanchion-base cover-plate hub 93 is inserted through central, circular base opening 79*c*. Base bearing 76 is slid on stanchion-base cover-plate hub 93. Snap ring 77 is snapped on snap-ring-retaining channel 97 to secure stanchion-base cover plate 71 to stanchion base 55.

Stanchion base 55 is inserted into central covering-top opening 103*b*, and stanchion base 55 is screwed on stabilizing foot 56 using stabilizing-foot screws 109. Stabilizing toot 56 is seated on umbrella-stanchion-system-covering bottom 104. Umbrella-stanchion-system-covering top 102 and umbrella-stanchion-system-covering bottom 104 are screwed together using covering-bottom washers 106 and covering-bottom screws 107.

Material

Each component of the unique multi-adjustable, rotating, and opposite-double-locking umbrella-stanchion system, independently from the others of the system, can be partially or entirely made of rigid material, non-rigid material, flexible material, non-flexible material, pliable material, non-pliable material, elastic material, non-elastic material, resilient material, non-resilient material, or a combination of at least two of the above.

For example, a component of the unique multi-adjustable, rotating, and opposite-double-locking umbrella-stanchion system can be made of any of the following materials: nylon, fabric, cotton, plastic, plastic composite, plasticized material, ABC, PVC, fiber class, iron, copper, zinc, bronze, tin, alloy, aluminum, stainless steel, or a combination of at least two of the above.

Operation

Figure 5A:
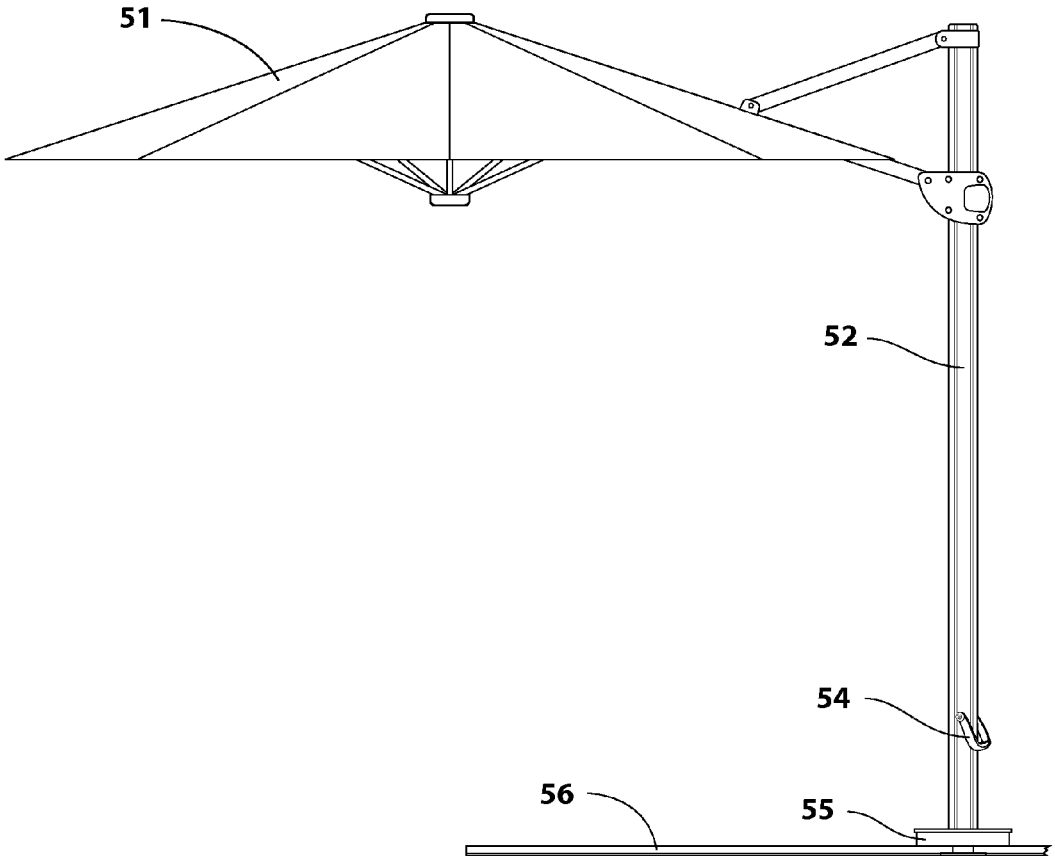
FIG. 5A illustrates a side view of the unique multi-adjustable, rotating, and opposite-double-locking umbrella-stanchion system, in locking position.
Figure 5B:
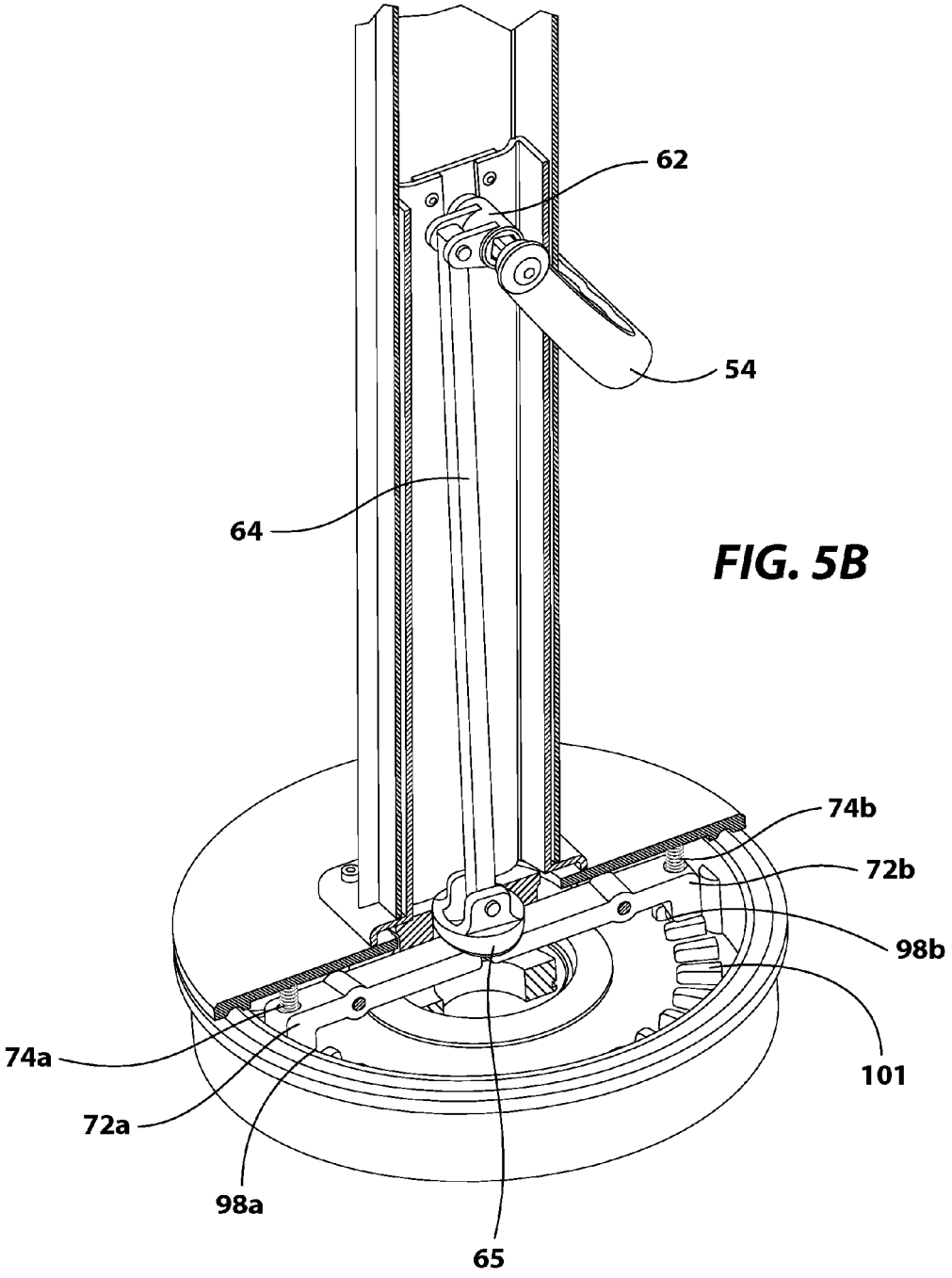
FIG. 5B illustrates a perspective view of the unique multi-adjustable, rotating, and opposite-double-locking umbrella-stanchion system, in locking position.

Referring to FIGS. 5A and 5B, two opposite tension springs 74*a* and 74*b* push two opposite locking cleats 98*a* and 98*b* downward between radial teeth 101, respectively, locking collapsible umbrella-canopy system 51 and umbrella-supporting post 52, in an original position.

Referring to FIGS. 6A, 6B, 6C, and 6D, to operate the unique multi-adjustable, rotating, and opposite-double-locking umbrella-stanchion system:

First, (referring to FIG. 6A) a user lifts U-shaped rotational lever 54 upward, in the direction of arrow 110, to rotate actuator arm 62 downward.

In turn, actuator arm 62 pushes push rod 64 downward.

In turn, push rod 64 pushes push-rod foot 65 downward.

In turn, push-rod foot 65 pushes the tails of two opposite L-shaped locking arms 72*a* and 72*b* downward, In turn, this rotates the heads of two opposite L-shaped locking arms 72*a* and 72*b* upward, respectively.

In turn, this rotates two opposite locking cleats 98*a* and 986 upward and over from radial teeth 101, respectively.

Figure 6A:
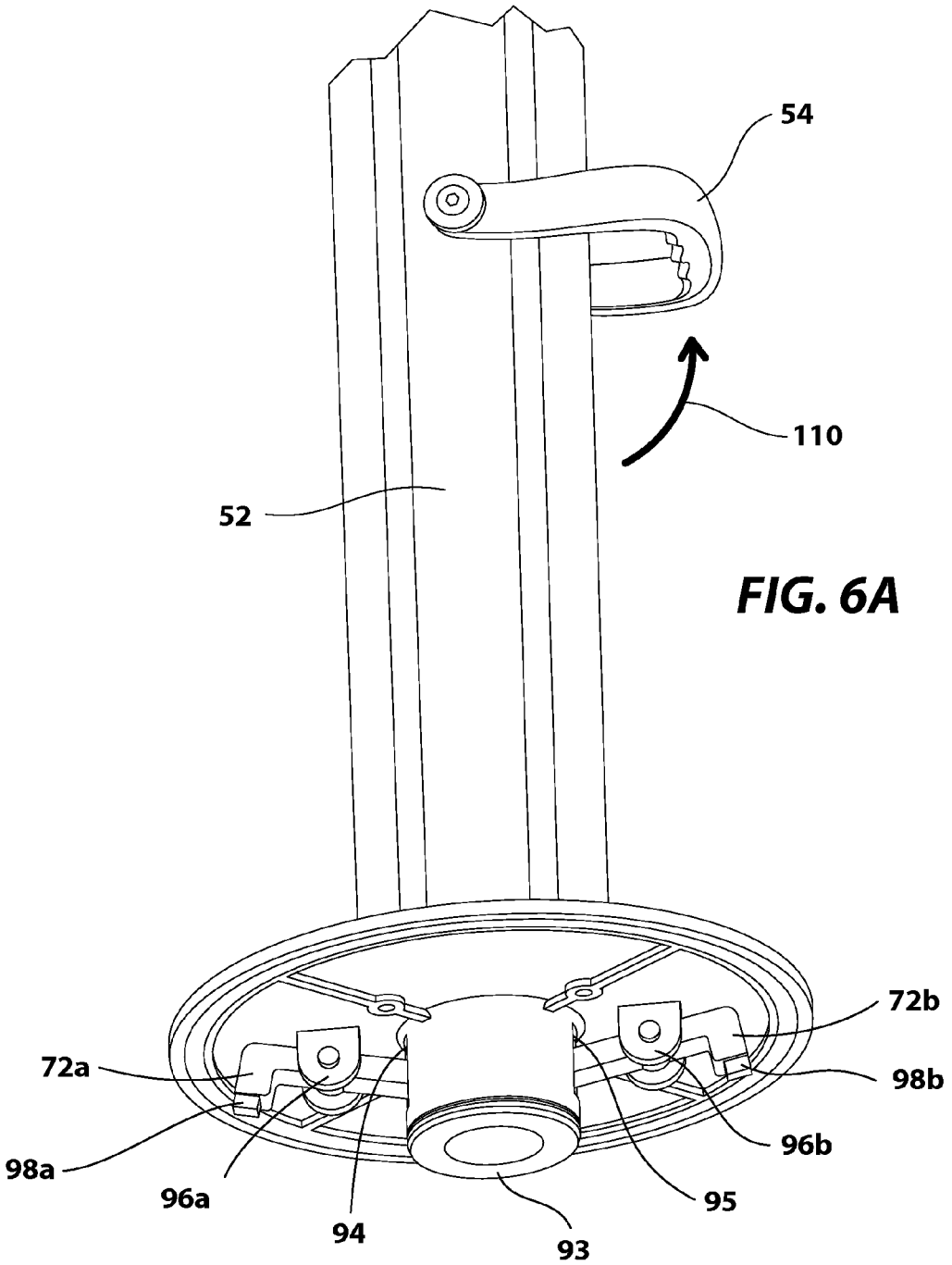
FIGS. 6A and 6B illustrate perspective views of the unique multi-adjustable, rotating, and opposite-double-locking, umbrella-stanchion system, in unlocking position.
Figure 6B:
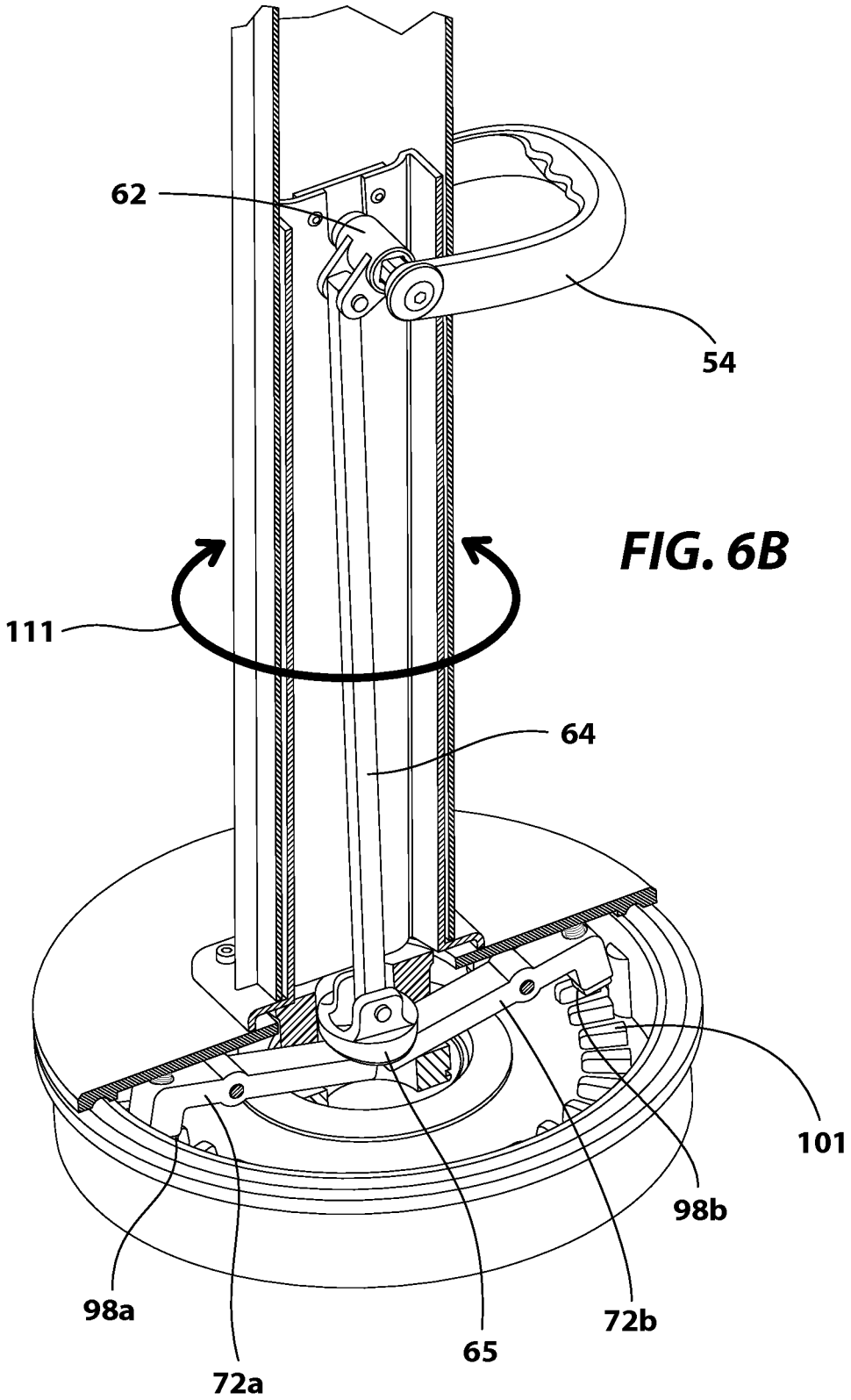
Figure 6C:
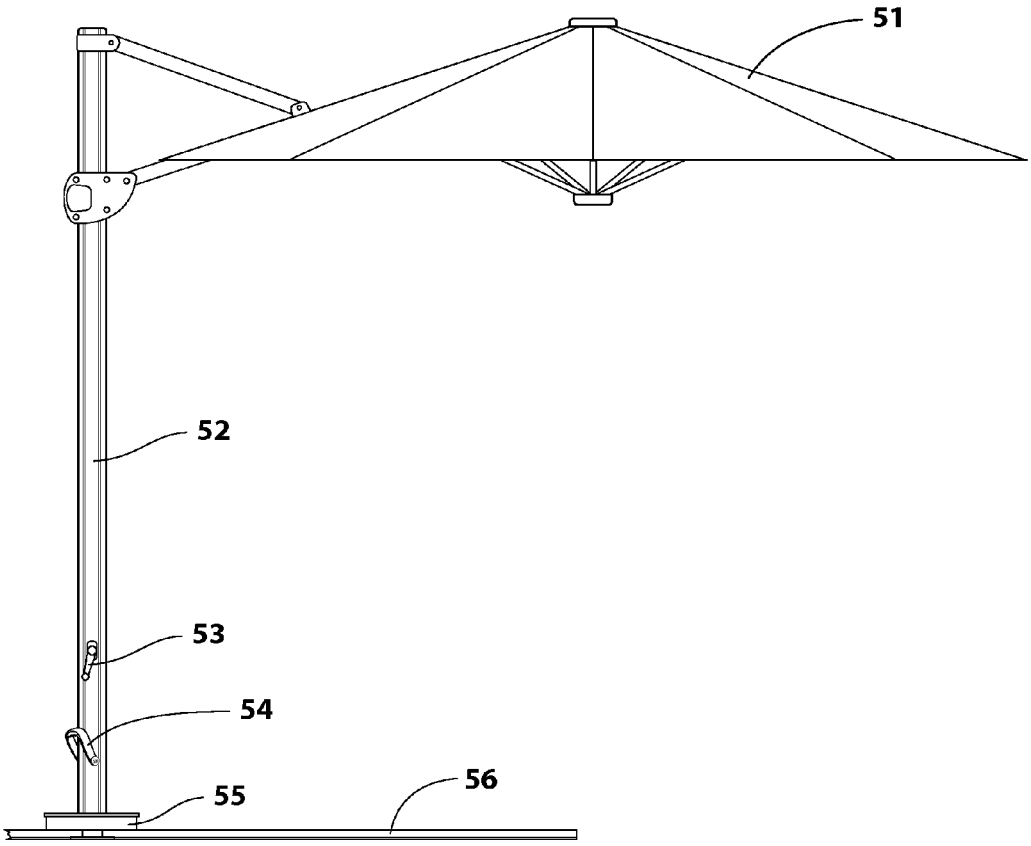
FIG. 6C illustrates a side view of the unique multi-adjustable, rotating, and opposite-double-locking umbrella-stanchion system, in unlocking position.
Figure 6D:
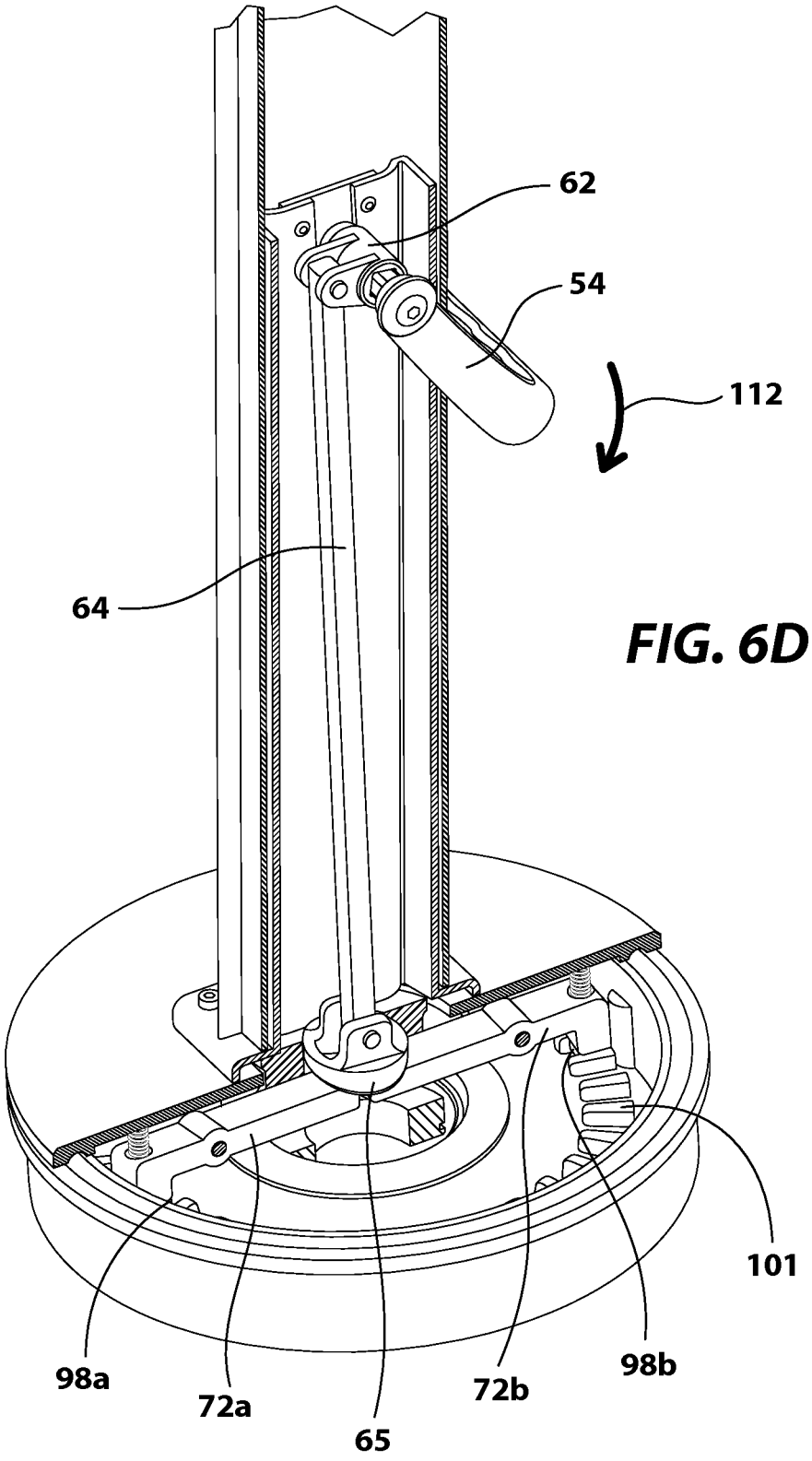
FIG. 6D illustrates a perspective view of the unique multi-adjustable, rotating, and opposite-double-locking umbrella-stanchion system, returning back to locking position.

As a result, this unlocks collapsible umbrella-canopy system 51 and umbrella-supporting post 52 from stanchion base 55;

Next, (referring to FIG. 68) the user rotates U-shaped rotational lever 54, in either direction of arrow 111, to rotate collapsible umbrella-canopy system 51 and umbrella-supporting post 52 to a new position (referring to FIG. 6C);

Then, (referring to FIG. 6D) the user releases U-shaped rotational lever 54.

In turn, two opposite tension springs 74*a* and 74*b* push the heads of two opposite L-shaped locking arms 72*a* and 726 downward.

In turn, this pushes two opposite locking cleats 98*a* and 98*b* downward, between radial teeth 101, respectively, locking collapsible umbrella-canopy system 51 and umbrella-supporting post 52, in place.

In turn, this rotates the tails of two opposite L-shaped locking arms 72*a* and 72*b* upward.

In turn, the tails of two opposite L-shaped locking arms 72*a* and 72*b* push push-rod foot 65 upward.

In turn, push-rod foot 65 pushes push rod 64 upward.

In turn, push rod 64 pushes actuator arm 62 upward.

In turn, actuator arm 62 rotates U-shaped rotational lever 54 downward, back to its original position, in the direction of arrow 112.

OBJECTS AND ADVANTAGES OF THE INVENTION

The unique multi-adjustable, rotating, and opposite-double-locking umbrella-stanchion system overcomes all the disadvantages of the prior art heretofore. The unique multi adjustable, rotating, and opposite-double-locking umbrella-stanchion system substantially departs from the conventional concepts and designs of the prior art. In doing so, the unique multi-adjustable, rotating, and opposite-double-locking umbrella-stanchion system provides many unique, significant advantages, some of which are, as follows:

1) It is an object of the present invention to provide a unique multi-adjustable, rotating, and opposite-double-locking umbrella-stanchion system, which can be operated with one finger. As a result, this invention eliminates the prior-art problem of requiring a user to use both hand and foot, simultaneously, to operate.

2) It is another object of the present invention to provide a unique multi-adjustable, rotating, and opposite-double-locking umbrella-stanchion system, which allows a user to keep both feet firmly on the ground while operating the system, especially when the ground is snowy or wet. As a result, this invention eliminates personal injuries, caused by the prior art.

3) It is another object of the present invention to provide a unique multi-adjustable, rotating, and opposite-double-locking umbrella-stanchion system, which eliminates a foot pedal protruding outward from the base of an umbrella, as needed in the prior art to operate its umbrella system. A foot pedal protruding from an umbrella base is very hazardous, for example, when there are a gathering with a lot of people and young children playing and running around. They can trip on the protruding foot pedal and fall. As a result, this invention eliminates personal injuries, caused by the prior art.

4) It is another object of the present invention to provide a unique multi-adjustable, rotating, and opposite-double-locking umbrella-stanchion system, which allows a user to keep both feet firmly on the ground while operating the system. As a result, this invention allows a user to rotate the system a substantially larger angle than the prior an can.

5) It is another object of the present invention to provide a unique multi-adjustable, rotating, and opposite-double-locking umbrella-stanchion system, which oppositely double-locks the umbrella post. As a result of this, the unique multi-adjustable, rotating, and opposite-double-locking umbrella-stanchion system will not bend out of shape, over an extended period of use. This increases its reliability.

6) It is another object of the present invention to provide a unique multi-adjustable, rotating, and opposite-double-locking umbrella-stanchion system, which can be operated with one finger. As a result, this eliminates the needs for using both hand and foot, simultaneously, to operate the system, a user must stand on one of his feet, and use the other foot and one of his hands, simultaneously. Therefore, the unique multi adjustable, rotating, and opposite-double-locking umbrella-stanchion system is simple to operate.

7) It is another object of the present invention to provide a unique multi-adjustable, rotating, and opposite-double-locking umbrella-stanchion system, which can be operated with one of his fingers, as follows:

a) A user simply lifts a lever on the umbrella post (with one of his fingers), and b) Simply rotates the umbrella post to a desired position, and releases the lever.

8) It is another object of the present invention to provide a unique multi-adjustable, rotating, and opposite-double-locking umbrella-stanchion system, which eliminates all hazardous levers, poking outward from the umbrella stand, keeping the umbrella stand smooth and stylish, and providing safety to user.

Variation and Ramification

Figure 7:
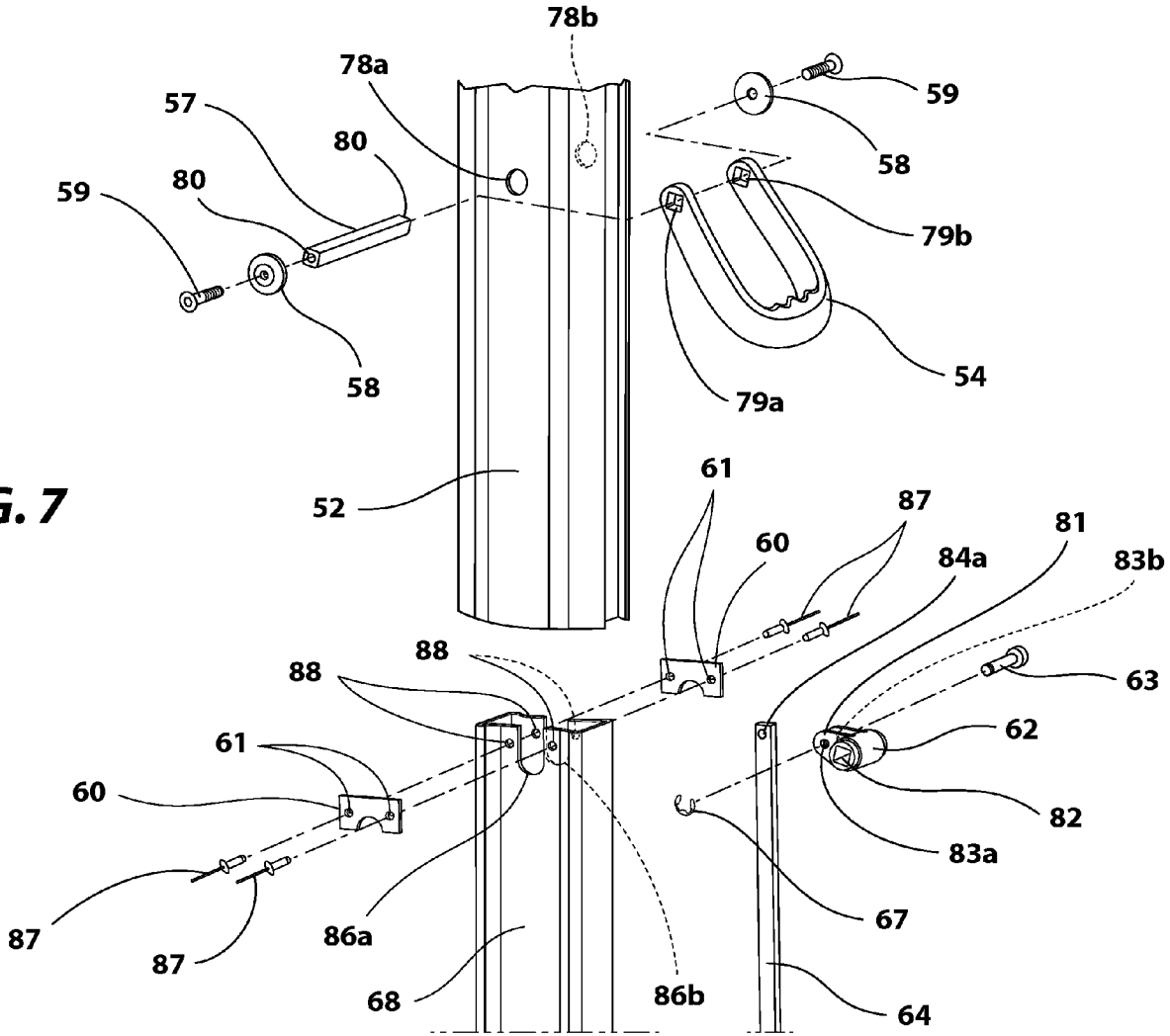
FIG. 7 illustrates an exploded view of the unique multi-adjustable, rotating, and opposite-double-locking umbrella-stanchion system.

The cross-section of U-shaped rotational lever 54 can have any size (refer to FIG. 7).

Any section of stabilizing foot 56 can have any size.

The cross-section of push rod 64 can have any size (refer to FIG. 7).

The cross-section of push-rod housing shaft 68 can have any size (refer to FIG. 7).

Figure 8:
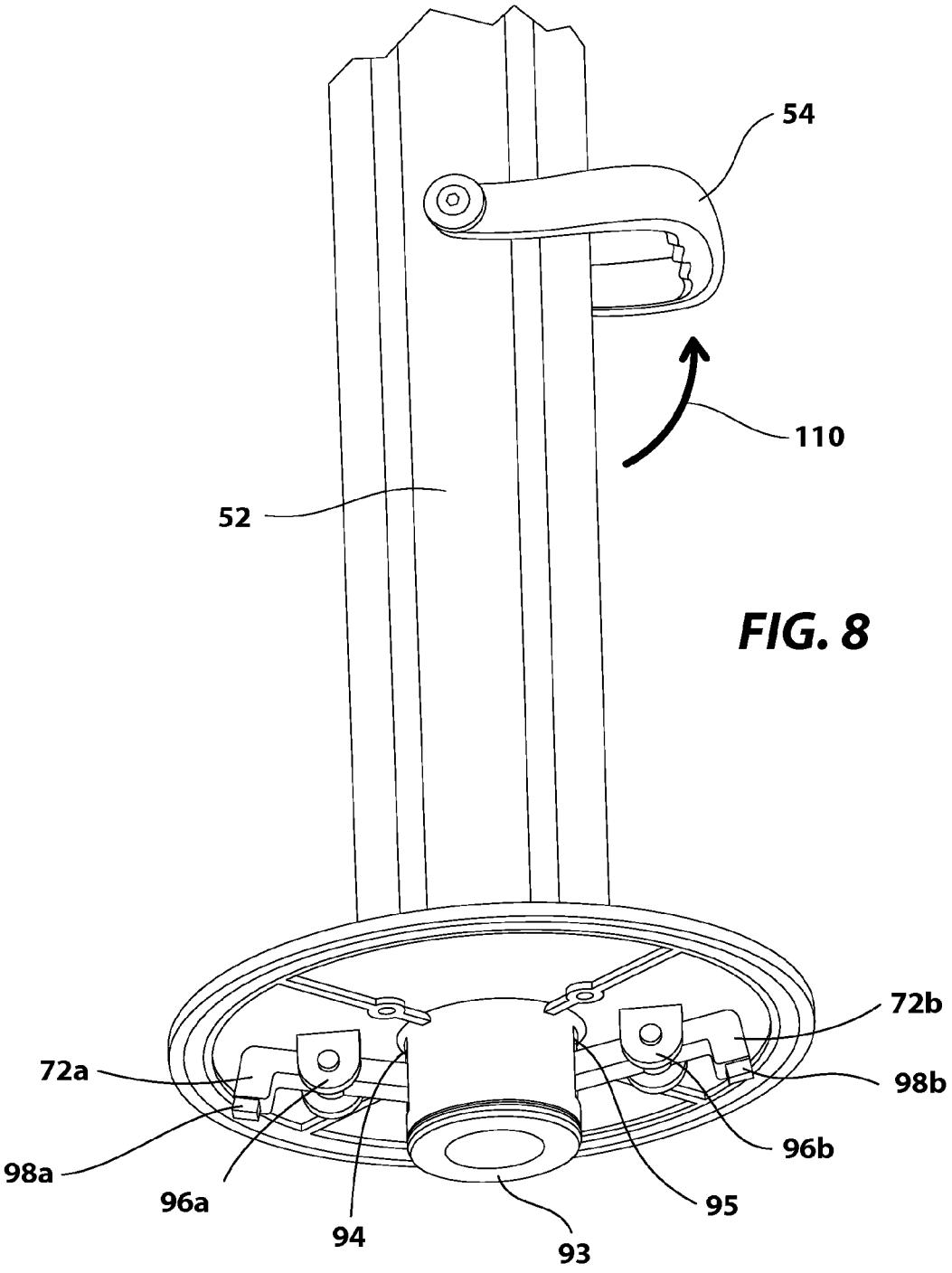
FIG. 8 illustrates a perspective view of the unique multi-adjustable, rotating, and opposite-double-locking umbrella-stanchion system, in unlocking position.

The cross-section of opposite L-shaped locking arms 72*a* and 72*b* can have any size (refer to FIG. 8).

Figure 9:
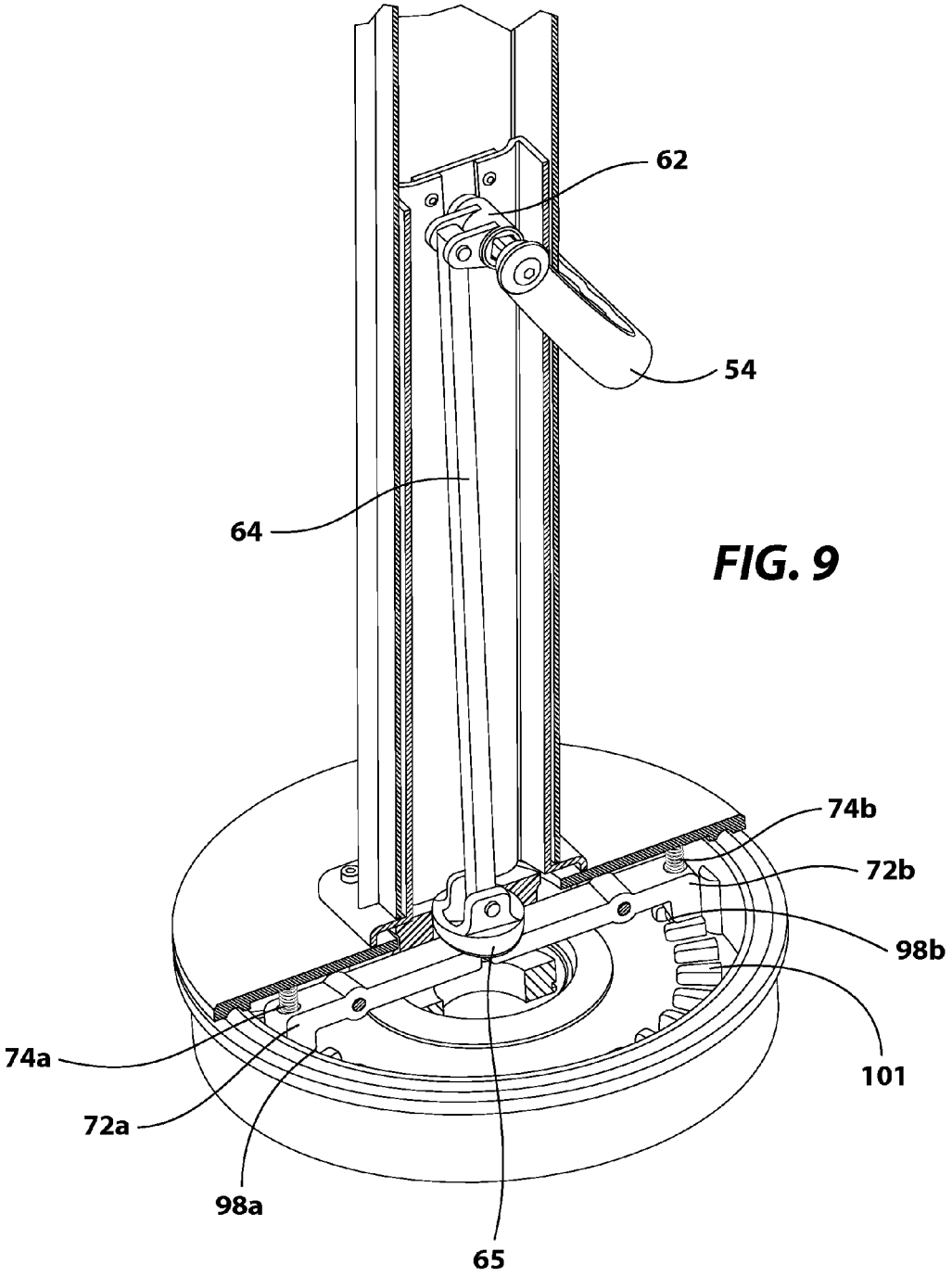
FIG. 9 illustrates a perspective view of the unique multi-adjustable, rotating, and opposite-double-locking umbrella-stanchion system, in locking position.

Two opposite tension springs 74*a* and 74*b* can have a resilient force of any strength (refer to FIG. 9).

Figure 10:
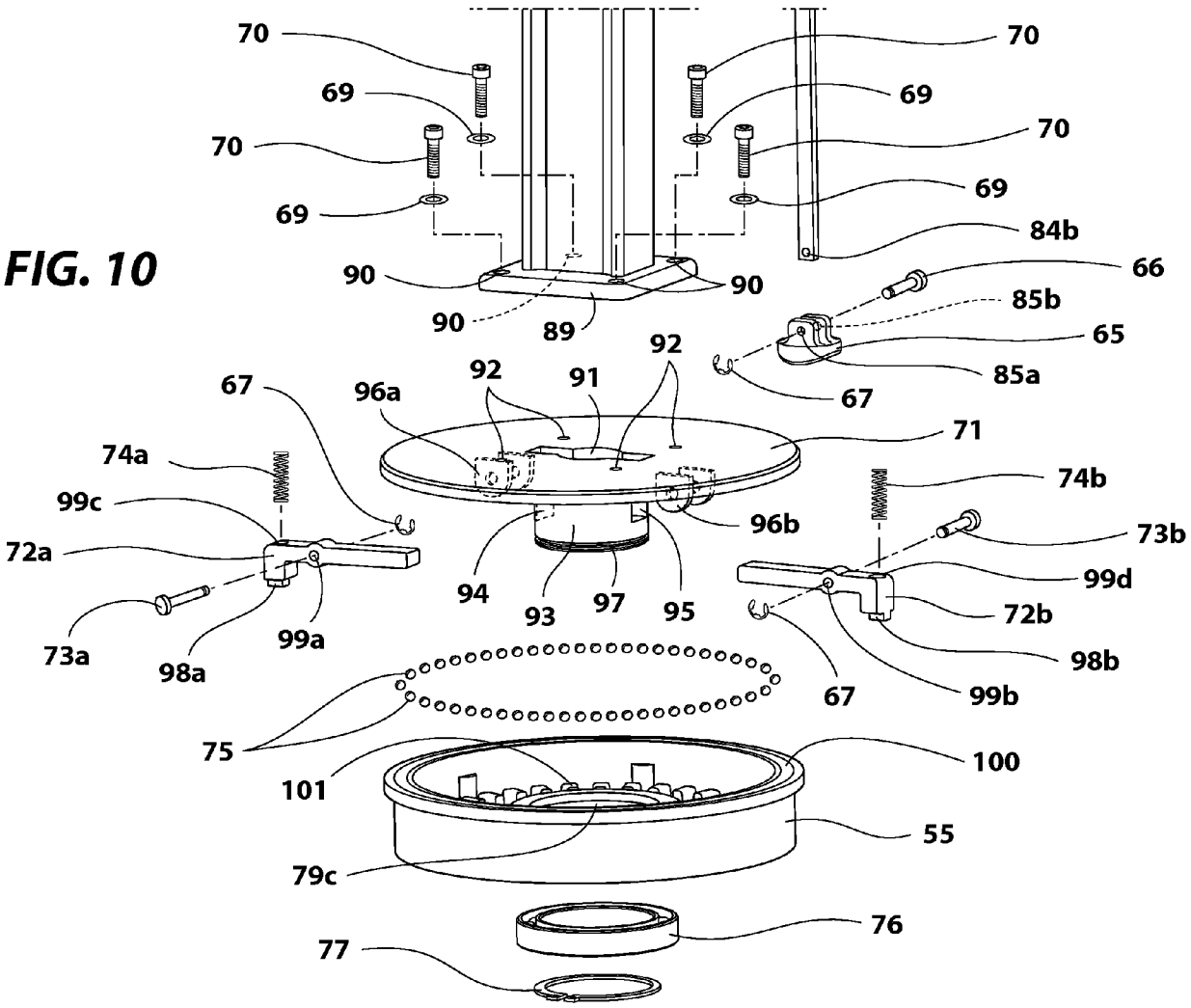
FIG. 10 illustrates an exploded view of the unique multi-adjustable, rotating, and opposite-double-locking umbrella-stanchion system.

Each of bail bearings 75 can have a diameter of any size (refer to FIG. 10).

Base bearing 76 can have a diameter of any size (refer to FIG. 10).

Radial teeth 101 can have any shape (refer to FIG. 10).

Umbrella-stanchion-system-covering top 102 can be square, round, or oval.

Umbrella-stanchion-system-covering bottom 104 can be square, round, or oval.

What is claimed is:

1. A unique multi-adjustable, rotatable, and opposite-double-locking umbrella-stanchion-and-stand system for being used with crank-arm-operated collapsible umbrella canopy comprises:

an umbrella-supporting post having two opposite post openings on its body;

a cover plate;

plate attaching means for attaching said cover plate to said umbrella-supporting post;

a stanchion cover hub molded to the center of the under surface of said cover plate;

a plurality of bearing balls;

a base, said base having a shape of a circular cup, said base having a circular bearing groove at its edge for said bearing balls to roll therein such that said umbrella-supporting post can be rotated;

a base bearing slid on said stanchion cover hub;

base attaching means for attaching said base to said cover plate, a plurality of radial teeth, said radial teeth molded to the circular corner of the inner surface of said base;

a stabilizing foot for stabilizing said umbrella-supporting post;

foot attaching means for attaching said stabilizing foot to said base;

a U-shaped rotational lever having two opposite square lever openings at its two opposite ends;

a U-shaped rotational actuator having a square actuator passage extending the width of its body;

a lever attaching means comprising a square-cross-sectional in and pin attaching means for attaching said pin to said umbrella-supporting post and to said rotational lever after said pin is inserted through said two opposite post openings, through said two opposite square lever openings, and through said square actuator passage;

a push rod;

a rod attaching means for attaching said push rod to said rotational actuator;

a U-shaped rotational foot;

a foot attaching means for attaching said rotational foot to said push rod;

two opposite L-shaped locking arms, each having a head and a tail, said cover plate having a plate passage for said rotational foot to pass through and rest on the tails of said locking arms; and two opposite arm attaching means for attaching said locking arms to the under surface of said cover plate at predetermined locations thereon such that the heads and tails of said two opposite locking arms can seesaw and such that the heads of said two opposite locking arms are pulled downward between said radial teeth by the gravitational force to lock said post in place, wherein, said rotational lever capable of being lifted upward to push the tails of said two opposite locking arms downward to raise the heads of said two opposite locking arms upward over said radial teeth to unlock said post to allow said post to rotate, wherein, said rotational lever capable of being lowered downward to push the tails of said two opposite locking arms upward to lower the heads of said two opposite locking arms downward between said radial teeth to lock said post to prevent said post from rotating, whereby the unique multi-adjustable, rotating, and opposite-double-locking umbrella-stanchion system is provided, which is operated with one finger, is simple and safe to operate, double-locks said post to prevent said post from warping, allows an operator to keep both feet on the ground while operating the system, eliminates any hazardous foot pedal protruding from said base, and eliminates personal injuries and provides safety to an operator.

2. The unique multi-adjustable, rotatable, and opposite-double-locking umbrella-stanchion-and-stand system of claim 1, further comprising two opposite tension springs, said cover plate having two opposite spring slots disposed at predetermined locations on its under surface for said two opposite tension springs to be inserted therein such that said two opposite tension springs push on said two opposite locking arms, respectively.

3. The unique multi-adjustable, rotatable, and opposite-double-locking umbrella-stanchion-and-stand system of claim 1, further comprising two opposite cleats attached to the heads of said two opposite locking arms, respectively, for guiding the heads in between said radial teeth.

4. The unique multi-adjustable, rotatable, and opposite-double-locking umbrella-stanchion-and-stand system of claim 1, further comprising a cover top for covering said cover plate, a cover bottom for covering said base, and bottom attaching means for attaching said cover bottom to said cover top.

5. The unique multi-adjustable, rotatable, and opposite-double-locking umbrella stanchion-and-stand system of claim 1, further comprising a plurality of knuckles integrated into said rotational lever.

6. The unique multi-adjustable, rotatable, and opposite-double-locking umbrella-stanchion-and-stand system of claim 1, wherein each of said radial teeth having a pointed tip.

7. The unique multi-adjustable, rotatable, and opposite-double-locking umbrella-stanchion-and-stand system of claim 1, wherein said push rod having a square or rectangular cross-section.

8. The unique multi-adjustable, rotatable, and opposite-double-locking umbrella-stanchion-and-stand system of claim 1, wherein said push rod having a round cross-section.

9. The unique multi-adjustable, rotatable, and opposite-double-locking umbrella-stanchion-and-stand system of claim 1, wherein said rotational lever having a square or rectangular cross-section.

10. The unique multi-adjustable, rotatable, and opposite-double-locking umbrella-stanchion-and-stand system of claim 1, wherein said rotational lever having a round cross-section.

11. A unique multi-adjustable, rotatable, and opposite-double-locking umbrella-stanchion-and-stand system for being used with crank-arm-operated umbrella canopy comprises:

an umbrella-supporting post having two opposite post openings on its body;

a cover plate;

plate attaching means for attaching said cover plate to said umbrella-supporting post;

a stanchion cover hub molded to the center of the under surface of said cover plate;

a plurality of bearing balls;

a base, said base having a shape of a circular cup said base having a circular bearing groove at its edge for said bearing balls to roll therein such that said umbrella-supporting post can be rotated;

a base bearing slid on said stanchion cover hub;

base attaching means for attaching said base to said cover plate, a plurality of radial teeth, said radial teeth molded to the circular corner of the inner surface of said base;

a stabilizing foot for stabilizing said umbrella-supporting post;

foot attaching means for attaching said stabilizing foot to said base;

a U-shaped rotational lever having two opposite square lever openings at its two opposite ends;

a U-shaped rotational actuator having a square actuator passage extending the width of body;

a lever attaching means comprising a square-cross-sectional pin and pin attaching means for attaching said pin to said umbrella-supporting post and to said rotational lever after said pin is inserted through said two opposite post openings; through said two opposite square lever openings, and through said square actuator passage;

a push rod;

a rod attaching means for attaching said push rod to said rotational actuator;

a U-shaped rotational foot;

a foot attaching means for attaching said rotational foot to said push rod;

two opposite L-shaped locking arms, each having a head and a tail, said cover plate having a plate passage for said rotational foot to pass through and rest on the tails of said locking arms; and two opposite arm attaching means for attaching said locking arms to the under surface of said cover plate at predetermined locations thereon such that the heads and tails of said two opposite locking arms can seesaw and such that the heads of said two opposite locking arms are pulled downward between said radial teeth by the gravitational force to lock said post in place, wherein, said rotational lever capable of being lifted upward to raise the heads of said two opposite locking arms upward over said radial teeth to unlock said post to allow said post to rotate, wherein, said rotational lever capable at being lowered downward to lower the heads of said two opposite locking arms downward between said radial teeth to lock said post to prevent said post from rotating, whereby the unique multi-adjustable, rotating, and opposite-double-locking umbrella-stanchion system is provided, which allows an operator to keep both feet on the ground while operating the system, eliminates any hazardous foot pedal protruding from said base, eliminates personal injuries and provides safety to an operator, is operated with one finger, is simple and safe to operate, and double-locks said post to prevent said post from warping.

12. The unique multi-adjustable, rotatable, and opposite-double-locking umbrella-stanchion-and-stand system of claim 11, wherein said rotational lever having a round cross-section.

13. The unique multi-adjustable, rotatable, and opposite-double-locking umbrella-stanchion-and-stand system of claim 11, wherein said rotational lever having a square or rectangular cross-section.

14. The unique multi-adjustable, rotatable, and opposite-double-locking umbrella-stanchion-and-stand system of claim 11, wherein said push rod having a round cross-section.

15. The unique multi-adjustable, rotatable, and opposite-double-locking umbrella-stanchion-and-stand system of claim 11, wherein said push rod having a square or rectangular cross-section.

16. The unique multi-adjustable, rotatable, and opposite-double-locking umbrella-stanchion-and-stand system of claim 11, wherein each of said radial teeth having a pointed tip.

17. The unique multi-adjustable, rotatable, and opposite-double-locking umbrella-stanchion-and-stand system of claim 11, further comprising a plurality of knuckles integrated into said rotational lever.

18. The unique multi-adjustable, rotatable, and opposite-double-locking umbrella-stanchion-and-stand system of claim 11, further comprising a cover top for covering said cover plate, a cover bottom for covering said base, and bottom attaching means for attaching said cover bottom to said cover top.

19. The unique multi-adjustable, rotatable, and opposite-double-locking umbrella-stanchion-and-stand system of claim 11, further comprising two opposite cleats attached to the heads of said two opposite locking arms, respectively, for guiding the heads in between said radial teeth.

20. The unique multi-adjustable, rotatable, and opposite-double-locking umbrella-stanchion-and-stand system of claim 11, further comprising two opposite tension springs, said cover plate having two opposite spring slots disposed at predetermined locations on its under surface for said two opposite tension springs to be inserted therein such that said two opposite tension springs push on said two opposite locking arms, respectively.

* * * * *